United States Patent [19]

Hoppe et al.

[11] Patent Number: 4,956,626

[45] Date of Patent: Sep. 11, 1990

[54] INDUCTOR TRANSFORMER COOLING APPARATUS

[75] Inventors: Richard J. Hoppe, Rockford; Mark W. Metzler, Davis, both of Ill.

[73] Assignee: Sundstrand Corporation, Rockford, Ill.

[21] Appl. No.: 296,830

[22] Filed: Jan. 13, 1989

[51] Int. Cl.[5] ..... H01F 27/10

[52] U.S. Cl. ..... 336/60; 165/179; 336/61

[58] Field of Search ..... 336/55, 58, 57, 60, 336/61, 62; 165/179

[56] References Cited

U.S. PATENT DOCUMENTS

| | | | |
|---|---|---|---|
| 1,742,985 | 1/1930 | Burnham | 336/60 |
| 1,790,906 | 2/1931 | Eckman | 336/62 |
| 2,547,065 | 4/1951 | Wadhams | 336/61 |
| 2,577,825 | 12/1951 | Strickland, Jr. . | |
| 2,579,522 | 12/1951 | Strickland, Jr. . | |
| 2,854,608 | 9/1958 | McGuire et al. | 336/60 |
| 3,144,627 | 8/1964 | Dunnabeck et al. | 336/55 |
| 3,151,304 | 9/1964 | Miller | 336/58 |
| 3,419,834 | 12/1968 | McKechnie et al. | 336/60 X |
| 3,437,965 | 4/1969 | Ragsdale | 336/61 |
| 3,551,863 | 12/1970 | Marton | 336/58 |
| 4,352,078 | 9/1982 | Moore | 336/60 |
| 4,482,879 | 11/1984 | Jackowicz | 336/55 |
| 4,491,817 | 1/1985 | Koyama | 336/60 |
| 4,577,175 | 3/1986 | Burgher et al. | 336/61 |
| 4,584,551 | 4/1986 | Buraher et al. | 336/61 |
| 4,739,825 | 4/1988 | Van Dusen et al. | 336/60 X |

FOREIGN PATENT DOCUMENTS

| | | | |
|---|---|---|---|
| 1464356 | 3/1969 | Fed. Rep. of Germany | 336/60 |

*Primary Examiner*—Thomas J. Kozma

*Attorney, Agent, or Firm*—Antonelli, Terry, Stout & Kraus

[57] ABSTRACT

Plate fin heat exchangers (11,12 or 34,35,36) for transformers (10) and inductors (30) made of laminated iron cores (16 and 44) and insulated wire coils (13,14,15 or 45, 46, 47, 48) placed around the legs of the cores (16 and 44) is provided in the form of a plate fin between the coils of wire. The wire coils (13,14,15 or 45,46,47,48) and respective heat exchangers (11,12 or 34,35,36) are sandwiched together with the leg of the iron core (16 or 44) passing through the sandwich. The heat generated in the coils is in direct contact with the surface of the heat exchangers (11,12 or 34,35,36). A narrow air gap (28 or 49) is incorporated in each of the plate fin heat exchangers (11,12 or 34,35,36) at the core leg of each coil (13,14,15 or 45,46,47,48) to reduce the path eddy currents can travel and thereby reduce eddy current losses which reduce the power of the transformer (10) or inductor (30).

10 Claims, 3 Drawing Sheets

INDUCTOR TRANSFORMER COOLING APPARATUS

TECHNICAL FIELD

The present invention relates to an improved inductor/transformer heat exchanger. More particularly, the present invention relates to a plate heat exchanger which permits cooling of transformers and inductors more effectively and efficiently by cooling of the wire coils where most heat is generated without the need for spraying the transformer or inductor directly with the coolant and which permits the number of plate heat exchangers to be increased depending upon the heat load and design of the transformer or inductor.

BACKGROUND ART

The effective cooling of transformers and inductors, particularly in aerospace applications where size and weight are important, has always been a problem. On one hand, it is important to keep the size and weight of the transformer and inductors at a minimum. On the other hand, the wire temperature must be kept at a sufficiently cool temperature to guarantee safe and reliable operation. These considerations often work at cross purposes. One way in which the prior art has attempted to deal with the problem has been by way of direct cooling, the method currently being used. Direct cooling applies to cooling medium so as to directly contact the wires and/or the iron core. In some applications, direct cooling is unacceptable.

For example, U.S. Pat. No. 2,577,825 shows a transformer in which a segment of metallic tubing is welded to the outer edges of the laminated core to utilize direct heat conduction for substantially reducing the transformer core temperature during the transformer operation. The core cooling unit is connected with the windings of the transformer so that the same coolant source may be used. With such an arrangement, the transformer can be arranged for series cooling or parallel cooling. In either type of cooling, however, this transformer is designed so that a coolant flows within the primary and secondary turns, i.e. direct contact. It will be appreciated that such an arrangement requires a much larger and heavier transformer as well as a more complex arrangement for connecting the coils to the coolant source.

U.S. Pat. No. 2,579,522 shows another transformer in which coolant connections are also provided to allow for circulation through the primary conductor windings either in series through the entire coil or in parallel.

U.S. Pat. No. 3,144,627, shows a core cooling arrangement in a stepdown transformer designed in an effort to minimize eddy currents and to efficiently dissipate heat generated in the core which is laminated and comprised of two identical E-shaped sections joined by a pair of bolts. Each of the sections has a water passage which passes centrally through its side to the center where it makes a right angle turn and passes out through the middle of the center leg. An air gap is formed between the adjacent surfaces of the end sections. Such an arrangement embeds the heat exchanger in the transformer core for cooling. However, we have found that most of the heat generated by the transformer is generated in the coils. Consequently, the arrangement shown in this patent does not provide the most efficient cooling for the transformer.

U.S. Pat. No. 3,151,304, discloses another structure which attempts to prevent the flow of eddy currents in the conductors. Two adjacent layers in a pancake coil are separated and a passageway is provided within the pancake coil for the cooling medium. However, this structure again uses direct cooling which, as noted above, is unacceptable in certain applications.

U.S. Pat. No. 3,551,863, illustrates a transformer in which heat exchange is intended to be facilitated by reducing the portion of the resistance to the flow of the heat which appears between the surface of the active parts of the transformer and cooling medium externally to reduce the temperature gradient of these active parts which are above the temperature of the cooling medium. To this end, a surface heat dissipator is connected to an exposed surface of the winding or the like of the transformer. The dissipators comprise at least one sheet of highly heat conductive material, and the heat is transferred from the heat generating active part to the stream of cooling medium through the heat dissipator. Although this arrangement is shown primarily used with air cooled transformers designed for operation with natural convection and alternative forced air cooling, it is also suggested that the dissipators can be used with a liquid cooled transformer. However, this conventional arrangement does not utilize direct contact between the surface of the heat exchanger and the coils where most of the heat is generated.

U.S. Pat. No. 4,352,078, shows an electrical inductive apparatus, such as a transformer, having pancake coils, an outer bag surrounding a foil-coated core and a dielectric fluid coolant introduced into the outer bag. The bag contains a core, static plate and insulating coating which is able to conform to any forces applied to it internally or externally and thereby distribute the dielectric coolant over the stacked pancake coils from which the coolant flows by gravity. Such an arrangement does not permit, however, the heat which is generated in the high voltage and low voltage coils to be in direct contact with the surface of the flexible bag.

U.S. Pat. No. 4,482,879 shows a transformer core cooling arrangement in which a thin, flat molded frame having a contour corresponding to the core laminations of a transformer is interleaved between an adjacent pair of the core laminations in liquid-type relationship thereto. This arrangement forms a plurality of internal passageways within the core for the passage of a liquid cooling medium in direct contact with the core laminations 22 to effect core cooling during transformer operation. Again, such an arrangement is not designed to maximize heat transfer from the area in which most heat is generated, namely the coils.

U.S. Pat. No. 4,491,817, shows a sheet wound transformer in which sheet conductors are wound into coils with an insulating sheet interposed between adjacent turns. Arcuate cooling panels are provided in the coils to maintain the coolant circuit completely separated from the insulating gas such as $SF_6$. To avoid high current density and a local temperature rise at the upper and lower end portions of the sheet-wound coils because of eddy currents flowing in the conductors, ribs in the cooling panels have inlet ends and outlet ends disposed obliquely to supply a larger part of the coolant through the upper and lower portions of the panels. Although such an arrangement is intended to reduce the size and weight of the transformer, it is limited to a sheet wound transformer in which the cooling panels are formed in arcuate or cylindrical shapes.

U.S. Pat. No. 4,739,825, shows another conventional core cooling arrangement for a liquid cooled transformer. However, as previously noted, it is the coils, not the core, which requires the most effective heat exchange.

DISCLOSURE OF THE INVENTION

The present invention overcomes the problems and disadvantages encountered in prior art heat exchangers for transformers or inductors made up of laminated iron cores and coils of insulated wire placed around the legs of the iron cores by adding a plate fin or plate flow heat exchanger between the coils of wire. The coils of wire and the heat exchanger are sandwiched together with the leg of the iron core passing through them.

It is an object of the present invention to provide a heat exchanger which is in direct contact with the surface of the coils where most of the heat is generated.

It is another object of the present invention to utilize a heat exchanger construction which will allow the number of plate heat exchangers to be multiplied depending upon the heat load and the design of the transformer or inductor.

It is a yet further object of the present invention to provide a heat exchanger which has particular application in the aerospace field.

It is still a further object of the present invention to provide a heat exchanger which allows the coil ampere rates to be 10,000 to 18,000 amps/in$^2$ which is equal to direct cooling and 6000 amps/in$^2$ for non-direct cooling designs which are typical in aerospace applications.

It is an advantage of the present invention to have a heat exchanger which uses the same liquid connections regardless of the number of units, thereby reducing the cost and configuration of fluid connections which will have to change depending upon the application.

It is another advantage of the present invention that where multiple heat exchangers are used, they can be arranged in series, parallel or both series and parallel to develop the optimum path for cooling as well as pressure drop.

It is a still further advantage of the present invention to have a heat exchanger which will also reduce eddy current resistant losses induced in the heat exchanger by the magnetic fields produced at the coils.

An object of the present invention is to reduce eddy current losses by incorporating a narrow air gap in the heat exchanger at the core leg of each coil to reduce the path eddy currents can travel, thereby reducing the eddy current power losses.

BRIEF DESCRIPTION OF THE DRAWINGS

These and further features, objects and advantages of the present invention will become more apparent from the following detailed description of the present invention when taken in conjunction with the accompanying drawings wherein.

BEST MODE FOR CARRYING OUT THE INVENTION Best

Figure 1:
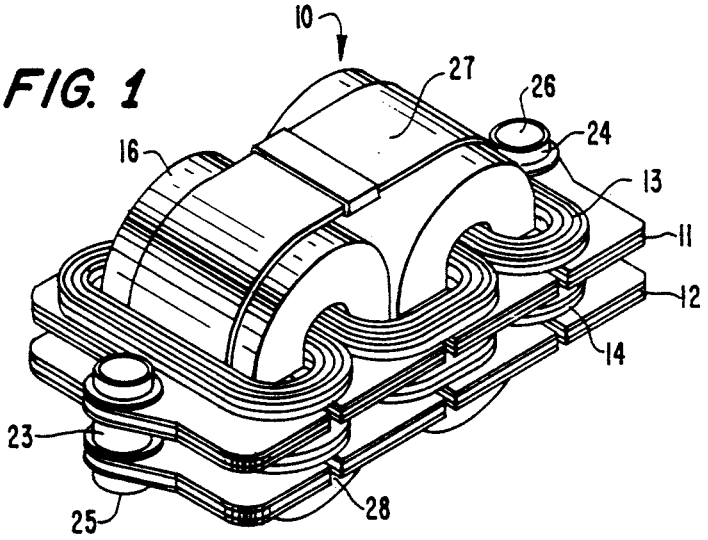
FIG. 1 is a perspective view of a transformer with cooling arrangement in accordance with the present invention.
Figure 2:
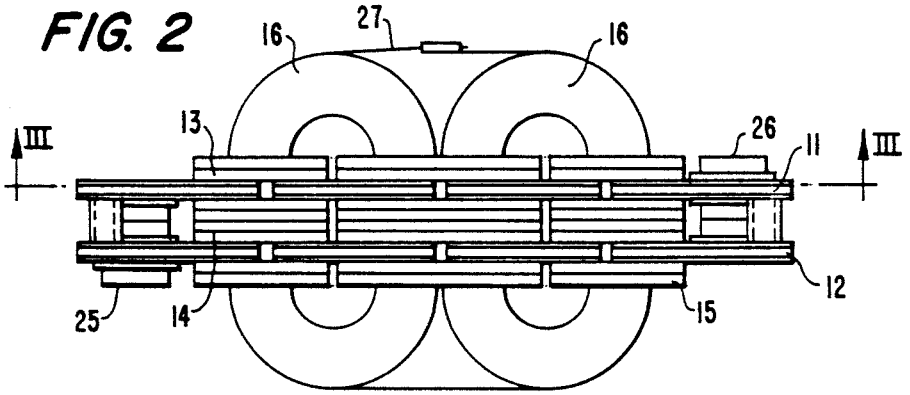
FIG. 2 is a side elevational view of the transformer shown in FIG. 1.

Referring now to the drawings and, in particular, to FIG. 1 there is shown a transformer such as, for example, what is known as a neutral forming transformer designated generally by the numeral 10. The transformer is a modular assembly consisting in the illustrated embodiment of two plate-fin heat exchangers 11,12 inserted between coils 13,14,15 which are wound around the legs 17,18 of electromagnetically permeable cores 16.

Figure 5:
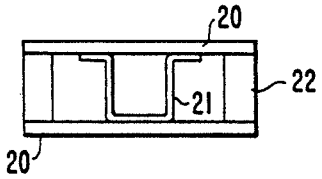
FIG. 5 is an isolated view of the fin geometry of the lanced offset fin stock of conventional construction used in the heat exchanger of the present invention.

The heat exchanger is an assembled plate of conventional clad aluminum sheet stock 20 and lanced offset fin stock 21 as shown in FIG. 5 to facilitate heat exchange between the heat source and coolant. The heat exchanger edges are sealed by a flow guide and spacer plate 22 (FIG. 3), and the heat exchanger assembly is vacuum-brazed together along with bosses 23,24 for porting of the coolant in and out of the heat through exchanger inlet 25 and an outlet 26.

Figure 3:
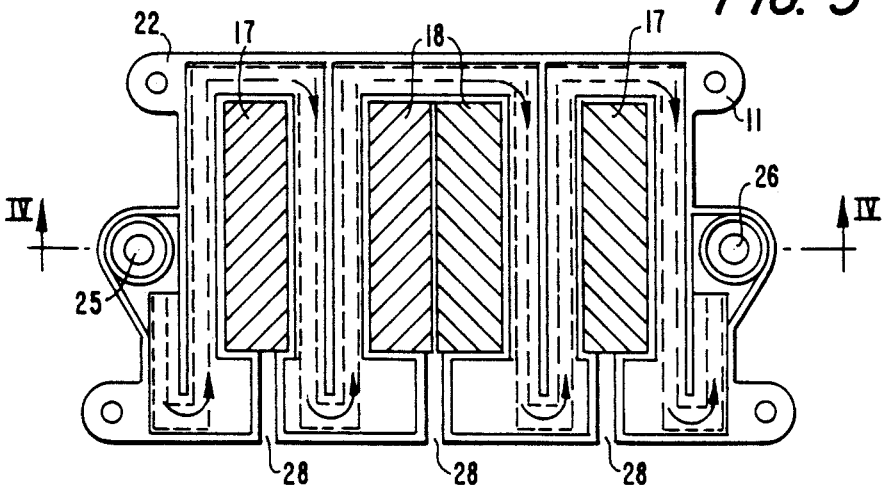
FIG. 3 is a cross-sectional view taken along line III—III of FIG. 2.
Figure 4:
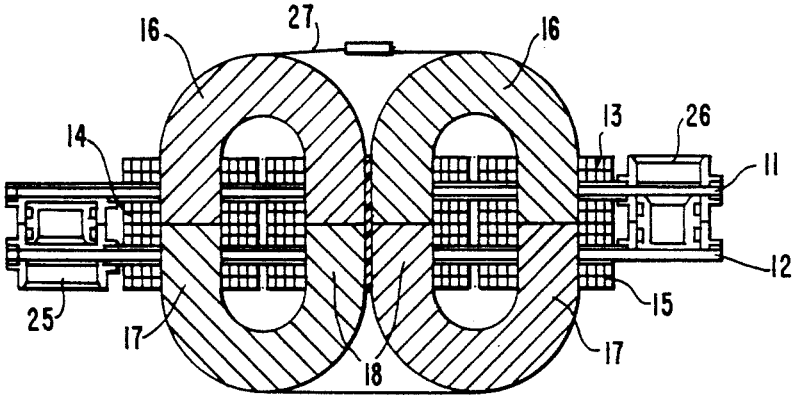
FIG. 4 is a cross-sectional side elevational view taken along line IV—IV of FIG. 3.

FIG. 3 shows the serpentine flow path designated by the arrows for a coolant such as Freon, which is chosen to provide both proper cooling and minimum pressure drop from the inlet 25 to the outlet 26. To assure parallel flow, the two plate lanced offset fin heat exchangers 11,12 in the transformer assembly 10 are plumbed in a well known manner. The heat exchangers 11,12 and the surrounding transformer winding layers 13,14,15 are designed so that a maximum of one layer of windings separates any other layer from a heat exchangers 11,12. As shown in FIG. 4, each winding 13,14,15 consists of two layers with a total of four layers existing between heat exchangers 11,12.

As shown in FIG. 4, the transformer 10 itself is made up of an iron "C" cores 16 banded together through a series of phase coils which are interconnected to each other. The coils 13,14,15 can be made, for example, of HML-coated rectangular wire, although other types of wire can be used without departing from the scope of the present invention. The transformer assembly 10 is built up with insulation such as Kapton insulation (not shown) and then assembled together with banding 27 and a retaining buckle.

The individual coil ends are soldered together in a zig-zag configuration so as to provide three phase input leads and a neutral lead in a known manner which need not be shown or described in detail here. Each connector is terminated with a lug for attaching to an output capacitor subassembly/internal terminal block. The entire assembly 10 is then vacuum-potted with high temperature insulation for enhanced thermal conductivity, mechanical integrity and electrical insulation. Of course, it is understood that the coolant ports 25,26 and mounting surfaces on the iron core are appropriately masked so that they are not coated with potting compound.

Figure 6:
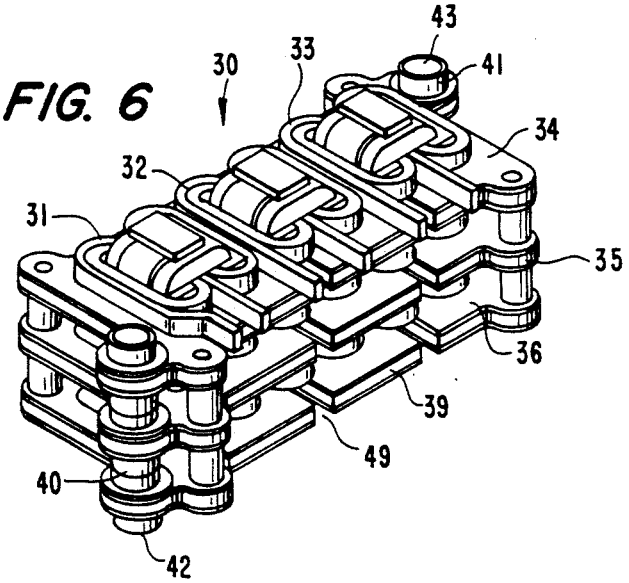
FIG. 6 is a perspective view of an inductor assembly consisting of three inductors and three common heat exchangers in accordance with the present invention.

The inductor assembly designated generally by the numeral 30 in FIG. 6 is a modular assembly consisting of three inductors 31,32,33 attached to three common plate fin heat exchangers 34,35,36. This assembly can be fastened to a current transformer subassembly (not shown) which includes the phase bus bars. Each of the three inductors has electromagnetically permeable C-shaped cores 44 (FIG. 8) which are wired with continuous wound coils 45, 46, 47, 48. The coils can be in layers and also be of HML-coated rectangular wire with spaces therebetween to accept the heat exchangers 34,35,36. All of the electric interconnects are brazed in a known manner to make the assembly inseparable.

Figure 10:
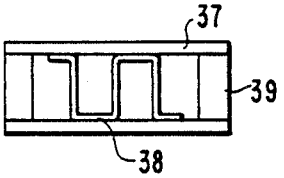
FIG. 10 is an isolated sectional view of the fin geometry of the conventional lanced offset fin stock used in the heat exchanger incorporated in the inductor assembly of FIG. 6.

As was the case in connection with the heat exchanger for the transformer assembly in FIG. 1, the plate lanced offset fin heat exchangers for the inductor assembly also comprise conventional clad aluminum sheet stock 37 and lanced offset fin stock 38 as shown in FIG. 10. The plate fin heat exchanger edges are sealed by a flow guide and spacer plate 39 (FIG. 6) with the assembly being vacuum-brazed together along with bosses 40,41 for coolant porting through inlet 42 to outlet 43.

Figure 7:
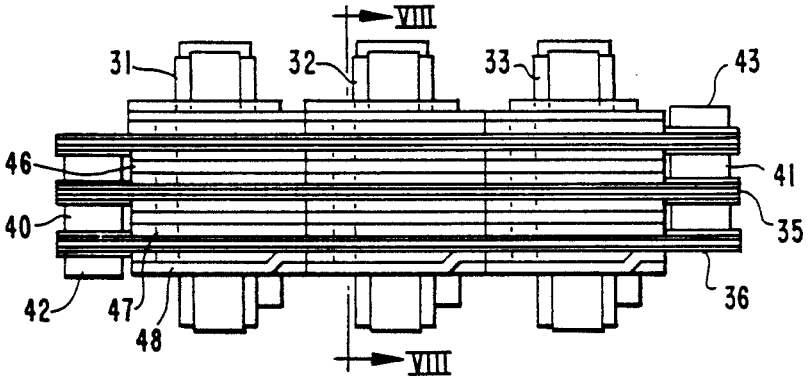
FIG. 7 is a side elevational view of the inductor assembly shown in FIG. 6.
Figure 9:
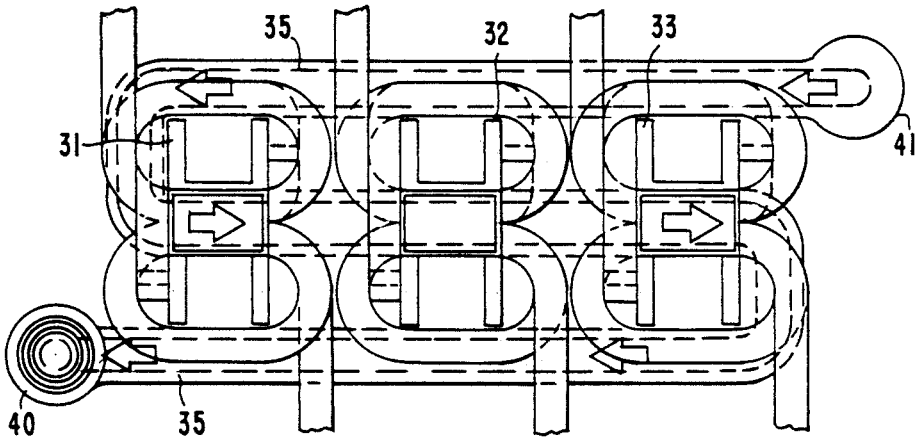
FIG. 9 is a cross-sectional view showing a coolant path through an induction assembly similar to FIGS. 6 and 7 but in which the axes of the cores are in line instead of parallel to one another as in FIGS. 6 and 7.
Figure 8:
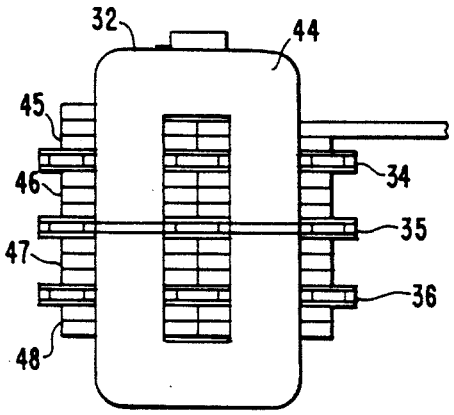
FIG. 8 is a cross-sectional view taken along line XIII—XIII of FIG. 7.

A typical flow path of an alternative embodiment of the heat exchanger shown in FIGS. 6–8, with similar parts designated by the same numerals but primed, in this example the middle heat exchanger is shown schematically in FIG. 9 where the arrows designate the S-shaped flow in each of the three heat exchangers. Again, the flow path is chosen to provide proper cooling of the coils and minimum pressure drop, and the heat exchangers are plumbed for parallel flow.

Similar to the transformer assembly 10 of FIG. 1, the inductor assembly 30 of FIG. 6 has a cooling system which consists of a plurality of plate fin heat exchangers 34,35,36 through which the core 44 of each of the inductors extends. Windings 45,46,47,48 are wound around the core 44 of each of the inductors 31,32,33. The plate offset lanced fin heat exchangers 34,35,36 are in direct contact with a layer of each winding or are separated by no more than one layer from an intermediate layer. The heat exchangers are sandwiched between layers of the C-shaped iron core and, more importantly, the coils which generate the largest amount of heat.

Furthermore, as is well known, transformers and inductors operating at high power densities generate tremendous electromagnetic fields. Because the heat exchanger is made of metal, the transformer or inductor will induce a current in the heat exchanger itself. Ordinarily, this would result in a heating of the heat exchanger and thus would deprive the electrical device of wanted power. In order to prevent this induced current, air gaps 28 (FIGS. 1 and 3) and 49 (FIG. 6) are placed in the heat exchanger to reduce eddy current resistance losses.

As a result of the foregoing arrangements, the heat exchangers in accordance with the present invention permit the size and weight of the electrical device to be kept at a minimum while assuring that the wire temperature is maintained at a safe and cool temperature, these being matters of particular importance in aerospace applications where size and weight are critical and total reliability is absolutely essential. Furthermore, this arrangement provides for tremendous flexibility in dealing with heat loads and allowing the design of the electrical element to be simplified by permitting any number of plates to be used by sandwiching the heat exchangers with the coils and then passing the iron core through the assembly of the wire coils and heat exchangers.

While we have shown and described several embodiments in accordance with the present invention, it is to be clearly understood that the same is susceptible of numerous changes and modifications without departing from the scope of the present invention. Therefore, we do not intend to be limited to the details shown and described herein but intend to cover all such changes and modifications as are encompassed by the scope of the appended claims.

We claim:

1. An electrical device in the form of a transformer or an inductor, comprising a permeable core having at least one leg about which is wrapped at least one coil layer through which electric current flows to generate heat, and at least one metal, plate-shaped, plate-fin heat exchanger with lanced offset fins having a configuration through which said core passes, a liquid coolant and inlet admitting said liquid coolant into a path therein and an outlet permitting said liquid coolant heated by the coil layer to exit therefrom, wherein the heat exchanger is in contact with the at least one coil layer for directly cooling the at least one coil layer and wherein said heat exchanger includes air gaps to reduce eddy current resistance losses.

2. An electrical device according to claim 1, wherein the heat exchanger has an S-shaped cooling path around the at least one leg of the core between the coolant inlet and the coolant outlet.

3. An electrical device according to claim 1, wherein the heat exchanger has an undulating cooling path around the at least one leg of the core between the coolant inlet and the coolant outlet.

4. An electrical device according to claim 1, wherein a plurality of coil layers are wrapped around the at least one leg, and the heat exchanger has planar surfaces on each side which are in direct contact with the layers.

5. An electrical device according to claim 4, wherein the heat exchanger has an S-shaped cooling path around the at least one leg of the core between the coolant inlet and the coolant outlet.

6. An electrical device according to claim 4, wherein the heat exchanger has an undulating cooling path around the at least one leg of the core between the coolant inlet and the coolant outlet.

7. An electrical device according to claim 1, wherein said device is a transformer assembly, said core having core pieces with the legs defining an E-shape and said at least one coil layer including separate coil layers wound around each of the legs, said at least one heat exchanger with lanced offset fins being located between and in contact with adjacent coil layers for directly cooling the adjacent coil layers and defining an undulating cooling path from said coolant inlet to said coolant outlet around the legs of the core pieces with said air gaps in the undulating cooling path to reduce eddy currents.

8. A cooling arrangement according to claim 7, wherein three separate coil layers are provided, and two of the heat exchangers are arranged between adjacent layers.

9. An electrical device according to claim 1, wherein said device is an inductor assembly, said core having core pieces with the legs defining a C-shape and said at least one coil layer including separate coil layers wound around each of the core pieces, said at least one heat exchanger being located between and in contact with adjacent coil layers for directly cooling the adjacent coil layers and defining an S-shaped path around and between the legs from said coolant inlet to said coolant outlet with said air gaps in the S-shaped path to reduce eddy currents.

10. A cooling arrangement according to claim 9, wherein four separate coil layers are provided, and three of the heat exchangers are arranged between adjacent layers.

* * * * *